US009039136B2

(12) United States Patent
Takano et al.

(10) Patent No.: US 9,039,136 B2
(45) Date of Patent: May 26, 2015

(54) WASTE INK ABSORBER, WASTE INK TANK, LIQUID DROPLET EJECTION DEVICE

(71) Applicant: SEIKO EPSON CORPORATION, Tokyo (JP)

(72) Inventors: Hidehiro Takano, Nagano (JP); Toshiaki Yamagami, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/201,064

(22) Filed: Mar. 7, 2014

(65) Prior Publication Data

US 2014/0267492 A1 Sep. 18, 2014

(30) Foreign Application Priority Data

Mar. 14, 2013 (JP) ..... 2013-051383

(51) Int. Cl.
*B41J 2/165* (2006.01)
*B41J 2/17* (2006.01)

(52) U.S. Cl.
CPC ..... *B41J 2/1721* (2013.01); *B41J 2/16523* (2013.01); *B41J 2/16532* (2013.01)

(58) Field of Classification Search
CPC ... B41J 2/1721; B41J 2/16523; B41J 2/16508
USPC ..... 347/29, 31, 36
See application file for complete search history.

(56) References Cited

U.S. PATENT DOCUMENTS 7,661,790 B2 * 2/2010 Harada et al. ..... 347/36
2012/0069086 A1 3/2012 Tanaka

FOREIGN PATENT DOCUMENTS

JP 2012-086551 A 5/2012

* cited by examiner

*Primary Examiner* — An Do
(74) *Attorney, Agent, or Firm* — Global IP Counselors, LLP

(57) ABSTRACT

A waste ink absorber for absorbing waste ink discharged from a head for ejecting ink includes layers the same in density and different in flame retardant content ratio, which are stacked.

8 Claims, 5 Drawing Sheets

WASTE INK ABSORBER, WASTE INK TANK, LIQUID DROPLET EJECTION DEVICE

CROSS-REFERENCE TO RELATED APPLICATIONS

This application claims priority to Japanese Patent Application No. 2013-051383 filed on March 14. The entire disclosure of Japanese Patent Application No. 2013-051383 is hereby incorporated herein by reference.

BACKGROUND

1. Technical Field

The present invention relates to a waste ink absorber, a waste ink tank, a liquid droplet ejection device.

2. Related Art

As a waste ink tank for collecting discharged ink, a structure is known in which a plurality of ink absorbing materials are arranged in an overlapped manner inside of a tank main body (For example, see Japanese Unexamined Laid-open Patent Application Publication No. 2012-86551).

However, the density of each of waste liquid absorbers stacked in the waste ink tank is approximately uniform. Therefore, there are following problems. That is, in cases where the permeability of waste liquid is relatively good with respect to a waste liquid absorber, the retention capacity for retaining the absorbed waste liquid deteriorates. On the other hand, in cases where the retention capacity of the absorbed waste liquid is relatively good with respect to the waste liquid absorber, the permeability for absorbing the waste liquid deteriorates. Further, conventionally, there is a case in which the density of the ink absorber is set to be low to quickly absorb especially pigment ink in which pigment particles are dispersed. In this case, the permeability of the pigment ink improves, but it was difficult to secure the retention capacity.

SUMMARY

The present invention was made to solve at least a part of the aforementioned problems, and can realize as the following embodiments or applied examples.

It is characterized in that a waste ink absorber for absorbing waste ink discharged from a head for ejecting ink according to the applied example includes a plurality of layers same in density and different in flame retardant content ratio, which are stacked.

With this structure, it becomes possible to equalize the density of the absorber at a low value, which can secure the permeability of the waste ink. Further, by equalizing the density of the absorber at a low value and laminating layers different in flame retardant content ratio, the retention capacity of the absorbed waste ink can be improved. Concretely, the content ratio of the flame retardant contained in each layer constituting the lamination is different every layer. Since the flame retardant is high in hydrophilic property, in the layer high in flame retardant content ratio, as compared with the layer relatively low in flame retardant content ratio, the retention capacity of the waste ink can be enhanced. Especially, to pigment ink in which pigment particles are dispersed, if the flame retardant content ratio is high, the dispensability of the pigment ink deteriorates and ink tends to easily aggregate, which can further improve the ink retention capacity. On the other hand, in a layer relatively low in flame retardant content ratio, it is possible to enhance the permeability of the waste ink. Therefore, as compared with an absorber which is uniform in flame retardant ratio, both properties of the ink permeability and the ink retention capacity can be enhanced. The waste ink denotes, for example, ink discharged from a head but not has reached a medium. Concretely, it refers to ink which is generated by flushing ink for the purpose of preventing increase in viscosity, or cleaning for forcibly discharging ink with a pump, etc., for the purpose of recovering a nozzle or preventing increase in viscosity. Further, in the so-called rimless printing, since the ink which deviated from a medium is also an ink which has not reached the medium, the ink is included in waste ink.

It is characterized in that the layers of the waste ink absorber according to the aforementioned applied example include a layer low in a flame retardant content ratio and a layer high in the flame retardant content ratio, and the layer low in the flame retardant content ratio is higher in a content ratio of fiber than the layer high in the flame retardant content ratio.

With this structure, by adjusting the flame retardant content ratio and the content ratio of fiber, the density can be easily equalized. With this, a waste ink absorber having ink permeability and ink retention capacity can be formed.

It is characterized in that the fiber of the waste ink absorber according to the aforementioned applied example is a fiber which functions as a main component of the waste ink absorber.

With this structure, by adjusting the content ratio of the fiber which functions as a main component of the waste ink absorber corresponding to the flame retardant content ratio, the density can be easily equalized.

It is characterized in that the aforementioned fiber of the waste ink absorber according to the aforementioned applied example is a melting fiber.

With this structure, by adjusting the content ratio of the melting fiber depending on the flame retardant content ratio, the density can be easily equalized.

In the waste ink absorber according to the aforementioned applied example, it is characterized in that, in a side cross-sectional view of the waste ink absorber, the layers are stacked parallel to each other.

With this structure, the layers can be easily stacked.

It is characterized in that in the waste ink absorber according to the aforementioned applied example, in a side cross-sectional view of the waste ink absorber, the layers are stacked obliquely.

With this structure, it becomes possible to make the waste ink easily permeate from the layer low in flame retardant content ratio and further make the waste ink easily permeate to the layer high in flame retardant content ratio.

It is characterized in that the waste ink tank according to this applied example includes the waste ink absorber, and an accommodation portion configured to accommodate the waste ink absorber.

With this structure, by accommodating the waste ink absorber having permeability and retention capacity of waste ink, for example, even in cases where the waste ink tank is arranged obliquely or sideways, the absorbed waste ink can be retained to prevent leakage, etc., which can provide a highly reliable waste ink tank.

It is characterized in that a liquid droplet ejection device according to this applied example includes a head for ejecting ink, and the waste ink tank configured to capture waste ink discharged from the head.

With this structure, the waste ink discharged from the head is captured by the waste ink absorber accommodated in the waste ink tank. The ink absorber is excellent in waste ink permeability and retention capacity. Therefore, since it effectively absorbs waste ink, it is possible to miniaturize as a waste ink tank and also to miniaturize as a liquid droplet ejection device. Further, it is possible to provide a liquid droplet ejection device which generates no defects such as ink leakage, etc., and is high in reliability.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, first and second embodiments of the present invention will be explained with reference to drawings. In each following drawing, the scale of each member, etc., is shown different from the actual scale to make each member, etc., recognizable size.

First Embodiment

A first embodiment will be explained.

Figure 1:
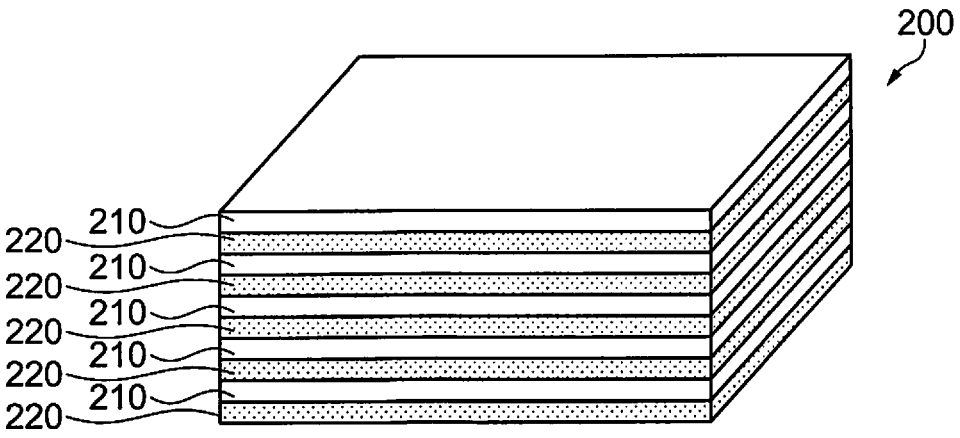
FIG. 1 is a schematic view showing a structure of a waste ink absorber according to a first embodiment.

Initially, the structure of a waste ink absorber will be explained. FIG. 1 is a schematic view showing the structure of the waste ink absorber according to this embodiment. The waste ink absorber 200 is for absorbing waste ink discharged from a head for ejecting ink, and is made of stacked layers which are same in density and different in flame retardant ratio. In this embodiment, as shown in FIG. 1, the waste ink absorber 200 includes a layer (first layer) 210 low in flame retardant ratio and a layer 220 (second layer) high in flame retardant ratio, and the first layer 210 and the second layer 220 are stacked alternately. In this embodiment, in the side cross-sectional view of the waste ink absorber 200, the first layer 210 and the second layer 220 are stacked parallel to each other. The number of staking of the first layer 210 and the second layer 220 is not specifically limited. Further, the layer (first layer) 210 low in flame retardant ratio is set to be higher in fiber ratio with respect to the layer (second layer) 220 high in flame retardant ratio. Fiber is a concept including one or both of cellulose fiber and melting fiber contained in each of the first layer 210 and the second layer 220. With this, the second layer 220 is higher in content ratio as compared with the first layer 210 and therefore becomes higher in hydrophilic property, and therefore is excellent in retention capacity for retaining the absorbed waste ink. Further, in the first layer 210, the permeability of the waste ink can be enhanced. As mentioned above, in the waste ink absorber 200, both properties of permeability and retention capacity of the waste ink can be enhanced.

The density of the first layer 210 and the density of the second layer 220 are the same. The first layer 210 and the second layer 220 are a mixture including a cellulose fiber, a melting fiber, and flame retardant, and the density of the first layer 210 and the density of the second layer 220 are defined by all materials contained in respective first layer 210 and second layer 220. The density is an average density of each layer and includes input errors of each material, and therefore the same density includes a variation of about ±10%.

A cellulose fiber is a fiber obtained by fibrillating a pulp sheet using a dry fibrillating machine, such as, example, a rotary crushing equipment, etc. A melting fiber enhances connection between cellulose fibers to thereby provide an appropriate strength (hardness, etc.) to the waste ink absorber 200, prevent scattering of paper powder/fibers, or contribute to configuration maintenance when absorbing waste ink. As the melting fiber, various kinds of forms such as a fibrous form or a powder form can be employed. By heating the mixture of cellulose fibers and melting fibers to melt the melting fibers, the melting fibers can be melted and solidified to the cellulose fibers. The melting is preferably performed at a temperature of the degree of not causing heat deterioration of the cellulose fiber, etc. Further, the melting fiber is preferably a fibrous form easily tangled with paper fibers in the fibrillated fiber. Further, it is preferable to be a composite fiber of a core-clad structure. In the melting fiber of a core-clad structure, the peripheral clad portion melts at low temperature and the core portion of the fibrous form is bonded to the melting fiber itself or the cellulose fiber to attain a strong bonding.

The flame retardant is added to give flame retardancy to the waste ink absorber 200. As the flame retardant, it is possible to use, for example, hydrated metallic salt compounds, such as, aluminum hydroxide, aluminum carbonate, magnesium hydrate, magnesium carbonate, huntite, hydromagnesite, calcium hydrate, calcium carbonate, zinc sulfate, dihydrate gypsum, calcium aluminate, dawsonite, and kaolin clay, or phosphate compounds containing, for example, amino group and/or ammonium group, such as, ammonium polyphosphate (APP), guanidine phosphate, ammonium phosphate, melamine polyphosphate, guanylurea phosphate, etc.

As a method for forming the waste ink absorber 200, for example, a mixture for the first layer 210 and a mixture for the second layer 220, in which cellulose fibers, melting fibers and flame retardant are mixed, are screened to alternately cause accumulation on a mesh belt arranged below the screen to thereby form a deposit. Then, the formed deposit is subjected to a heating and pressurizing treatment. With this, the melting fiber is molten and the deposit is formed into a desired thickness. Further, it is punched out into a desired size to thereby form a waste ink absorber 200 in which the first layer 210 low in content ratio of flame retardant and the second layer 220 high in content ratio of flame retardant are stacked parallel to one another.

Figure 2:
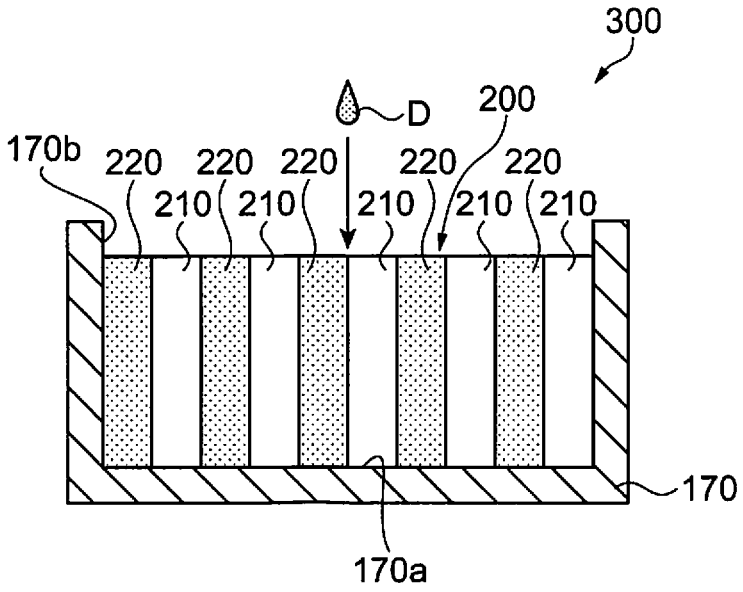
FIG. 2 is a cross-sectional view showing a structure of a waste ink tank equipped with a waste ink absorber according to the first embodiment.

Next, the structure of the waste ink tank will be explained. FIG. 2 is a cross-sectional view showing the structure of the waste ink tank according to this embodiment. As shown in FIG. 2, the waste ink tank 300 is provided with a waste ink absorber 200 for absorbing waste ink and an accommodation portion 170 for accommodating the waste ink absorber 200.

The waste ink absorber 200 includes, in a side cross-sectional view, a first layer 210 low in flame retardant ratio and a second layer 220 higher in flame retardant ratio than the first layer 210, and the first layer 210 and the second layer 220 are stacked alternately parallel to each other.

The accommodation portion 170 for accommodating the waste ink absorber 200 is formed into a rectangular shape by, e.g., plastic material. The accommodation portion 170 is provided with a bottom portion 170*a* and a side portion 170*b*, and formed so that the waste ink absorber 200 can be accommodated and retained.

As shown in FIG. 2, in this embodiment, the side on which the first layer 210 and the second layer 220 of the waste ink absorber 200 appear is arranged so as to come in contact with the bottom portion 170*a* of the accommodation portion 170. Therefore, the side on which both the first layer 210 and the second layer 220 of the waste ink absorber 200 appear appears on a surface. By arranging as mentioned above, the waste ink can be impregnated efficiently and the absorbed waste ink can be retained. Concretely, as shown in FIG. 2, the waste ink droplet D (especially, pigment ink) is discharged toward the waste ink absorber 200 and reaches the surface (first layer 210) of the waste ink absorber 200. When the waste ink droplet D comes into contact with the first layer 210 and the second layer 220 appearing on the surface of the waste ink absorber 200, the waste ink droplet permeates mainly from the first layer 210. The first layer 210 is relatively low in flame retardant content ratio, and therefore the waste ink easily permeates. The permeated waste ink permeates the second layer 220. The second layer 220 is relatively high in flame retardant content ratio, and therefore the retention capacity for retaining the absorbed waste ink can be enhanced. Further, in this embodiment, the first layer 210 and the second layer 220 are alternately stacked by five layers respectively, which can increase the absorption permissible amount of the waste ink.

Second Embodiment

Next, a second embodiment will be explained.

Figure 3A:
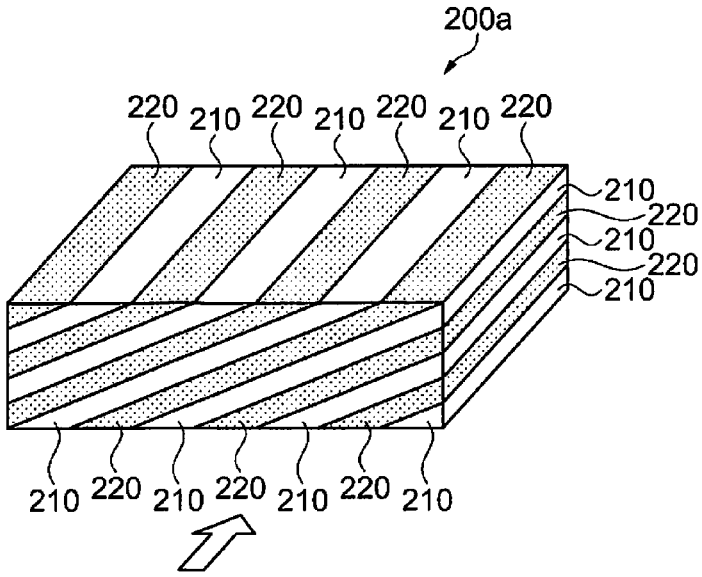
FIG. 3A is a schematic view showing a structure of a waste ink absorber according to a second embodiment.

Initially, the structure of the waste ink absorber will be explained. FIG. 3 is a schematic view showing the structure of the waste ink absorber according to this embodiment. This waste ink absorber 200*a* is configured to absorb the waste ink discharged from the head for ejecting ink, and is formed by laminating layers the same in density and different in flame retardant ratio. In this embodiment, as shown in FIG. 3A, the waste ink absorber 200*a* includes a layer (first layer) 210 low in flame retardant ratio and a layer (second layer) 220 high in flame retardant ratio, and the first layer 210 and the second layer 220 are stacked alternately. In this embodiment, in the side cross-sectional view of the waste ink absorber 200*a*, the first layer 210 and the second layer 220 are stacked obliquely.

This oblique lamination extends in a direction (arrow direction in FIG. 3A) perpendicular to the face on which the oblique lamination appears. "Oblique" of the oblique lamination denotes "oblique" with respect to the surface perpendicular to the surface on which the oblique lamination appears. As described, by obliquely laminating a plurality of the first layer 210 and the second layer 220 on one surface, on each surface of the waste ink absorber 200*a* perpendicular to the one surface, it is possible to make the first layer 210 and the second layer 220 appear alternately. On the surface perpendicular to the one surface, not oblique lamination but parallel or perpendicular lamination appears on each surface perpendicular to the one surface. In other words, the waste ink absorber 200*a* has, on three sides perpendicular with each other, one side appearing an oblique lamination and two sides appearing a parallel lamination. With this, on any side, the first layer 210 and the second layer 220 appear alternately, which enables easy absorption of the waste ink from any side. Further, the second layer 220 is higher in flame retardant content ratio as compared with the first layer 210, and therefore higher in hydrophilic property, resulting in excellent retention capacity for retaining the absorbed waste ink. Further, in the first layer 210, the permeability of waste ink can be enhanced. As discussed, in the waste ink absorber 200*a*, both properties of permeability and retention capacity of the waste ink can be enhanced.

Further, the layer (first layer) 210 low in flame retardant ratio is higher in fiber ratio compared with the layer (second layer) 220 high in flame retardant ratio. "Fiber" is a concept including one or both of the cellulose fiber and the melting fiber contained in each of the first layer 210 and the second layer 220.

Here, the surface of the waste ink absorber 200*a* which receives the water ink droplet is preferably constituted so that there exists plural laminations of the first layer 210 and the second layer 220. With this constitution, the waste ink absorbed from the first layer 210 permeates along the first layer 210 and further permeates by gravity the second layer 220 arranged below and the first layer 210 arranged further below, which can further enhance the efficiency of permeability and retention capacity. Further, by obliquely laminating, provided that the thickness of the absorber is the same, more layers can be formed as compared with the case in which layers are formed horizontally.

The width size, the number of laminations, etc., of the first layer 210 and the second layer 220 can be arbitrarily set. For example, on the surface of the waste ink absorber 200*a* which receives waste ink, it is preferable to stack the low density portion 220 and the high density portion 210 so that the stacked width is smaller than the width of the waste ink droplet. By structuring as mentioned above, the waste ink droplet comes into contact with both the first layer 210 and the second layer 220, which enables assured absorption from the first layer 210.

The waste ink absorber 200*a* is a mixture containing cellulose fibers, melting fibers and flame retardant, and the density of the first layer 210 and the density of the second layer 220 are the same. The density of each of the first layer 210 and the second layer 220 is defined by at least one of cellulose fiber, melting fiber, and flame retardant. The cellulose fiber, melting fiber and flame retardant are the same as those of the first embodiment, and therefore the explanation will be omitted.

As a method of forming the waste ink absorber 200*a*, for example, a mixture in which cellulose fibers, melting fibers and flame retardant are mixed is screened to cause accumulation on a mesh belt arranged below the screen to thereby form a deposit. At this time, the mesh belt is moved at a predetermined speed to cause accumulation so as to form a layer high in flame retardant ratio and a layer low in flame retardant ratio. Then the formed deposit is subjected to a heating and pressurizing treatment. With this, the melting fiber melts and the deposit is formed into a desired thickness. By punching out the deposit into a desired size, the waste ink absorber 200*a* is formed.

Figure 3B:
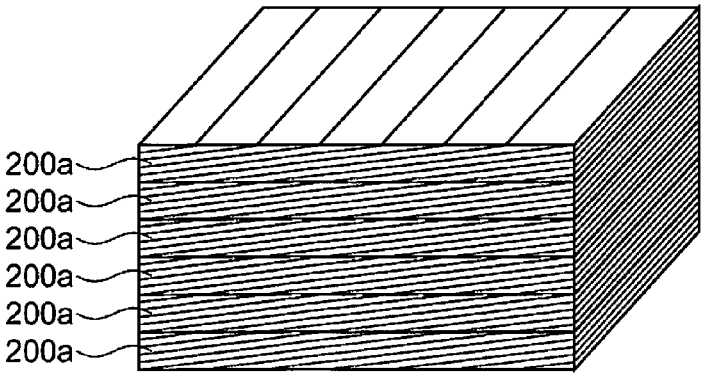
FIG. 3B is a schematic view showing the structure of the waste ink absorber according to the second embodiment.

FIG. 3B shows a structure in which a plurality of waste ink absorbers are stacked. As shown in FIG. 3B, a plurality of waste ink absorbers 200*a* are stacked. In this embodiment, it has a form that six pieces of waste ink absorbers 200*a* are stacked. The widest surfaces among the surfaces constituting the waste ink absorber 200*a* are in contact with each other. With this, the permeability of waste ink can be secured, and the absorption permissible amount of waste ink can be increased. The structure of each waste ink absorber 200*a* is the same as that shown in FIG. 3A, and therefore the explanation will be omitted.

Figure 4:
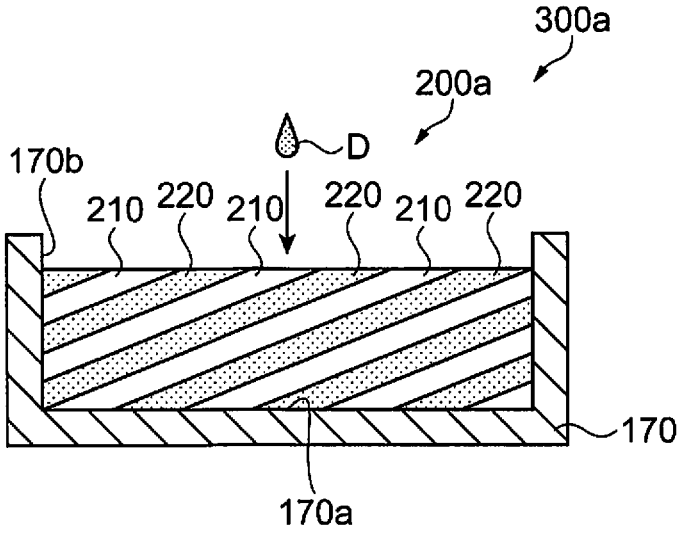
FIG. 4 is a cross-sectional view showing a structure of a waste ink tank equipped with a waste ink absorber according to the second embodiment.

Next, the structure of the waste ink tank will be explained. FIG. 4 is a cross-sectional view showing the structure of the waste ink tank according to this embodiment. As shown in FIG. 4, the waste ink tank 300*a* is provided with a waste ink absorber 200*a* for absorbing waste ink and an accommodation portion 170 for accommodating the waste ink absorber 200*a*.

The waste ink absorber 200*a* includes, at its side cross-sectional view, a first layer 210 low in flame retardant ratio and a second layer 220 higher in flame retardant ratio than the first layer 210, and the first layer 210 and the second layer 220 are stacked alternately. By laminating the first layer 210 and the second layer 220 obliquely as mentioned above, on the surface of the waste ink absorber 200*a*, the first layer 210 and the second layer 220 appear. Therefore, it becomes possible to absorb waste ink from any surface, eliminating the necessity of setting the arranging direction of the waste ink absorber 200*a*, etc., which can reduce the number of assembling steps.

The accommodation portion 170 for accommodating the waste ink absorber 200*a* is formed into a rectangular shape by, for example, plastic material. The accommodation portion 170 includes a bottom portion 170*a* and a side portion 170*b*, and is formed so that the waste ink absorber 200*a* can be accommodated and retained.

As shown in FIG. 4, when the waste ink droplet D (especially, pigment ink) is discharged toward the waste ink absorber 200*a* and reaches the surface of the waste ink absorber 200*a*, the waste ink droplet D comes into contact with both the first layer 210 and the second layer 220 appearing on the surface of the waste ink absorber 200*a*. The waste ink is absorbed efficiently from the first layer 210. The absorbed waste ink is retained by the second layers 220 stacked alternately.

In the aforementioned waste ink tank 300*a*, it is structured such that one sheet of waste ink absorber 200*a* is used, but not limited to this structure. For example, it can be configured to stack a plurality of waste ink absorbers 200*a*. In this case, the absorption permissible amount of the waste ink can be further increased. Further, in the aforementioned waste ink tank 300*a*, the widest surface is arranged in the horizontal direction (arranged sideways), but not limited to it. The widest surface can be arranged in the vertical direction (vertically arranged). Also in this arrangement, it is possible to permeate and retain waste ink.

Next, the structure of a liquid droplet ejection device will be explained. The liquid droplet ejection device is provided with a head for ejecting ink and a waste ink tank for capturing the waste ink discharged from the head. In the liquid droplet ejection device of this embodiment, the structure having the aforementioned waste ink absorber 200 (200*a*) and waste ink tank 300 (300*a*) will be explained.

Figure 5:
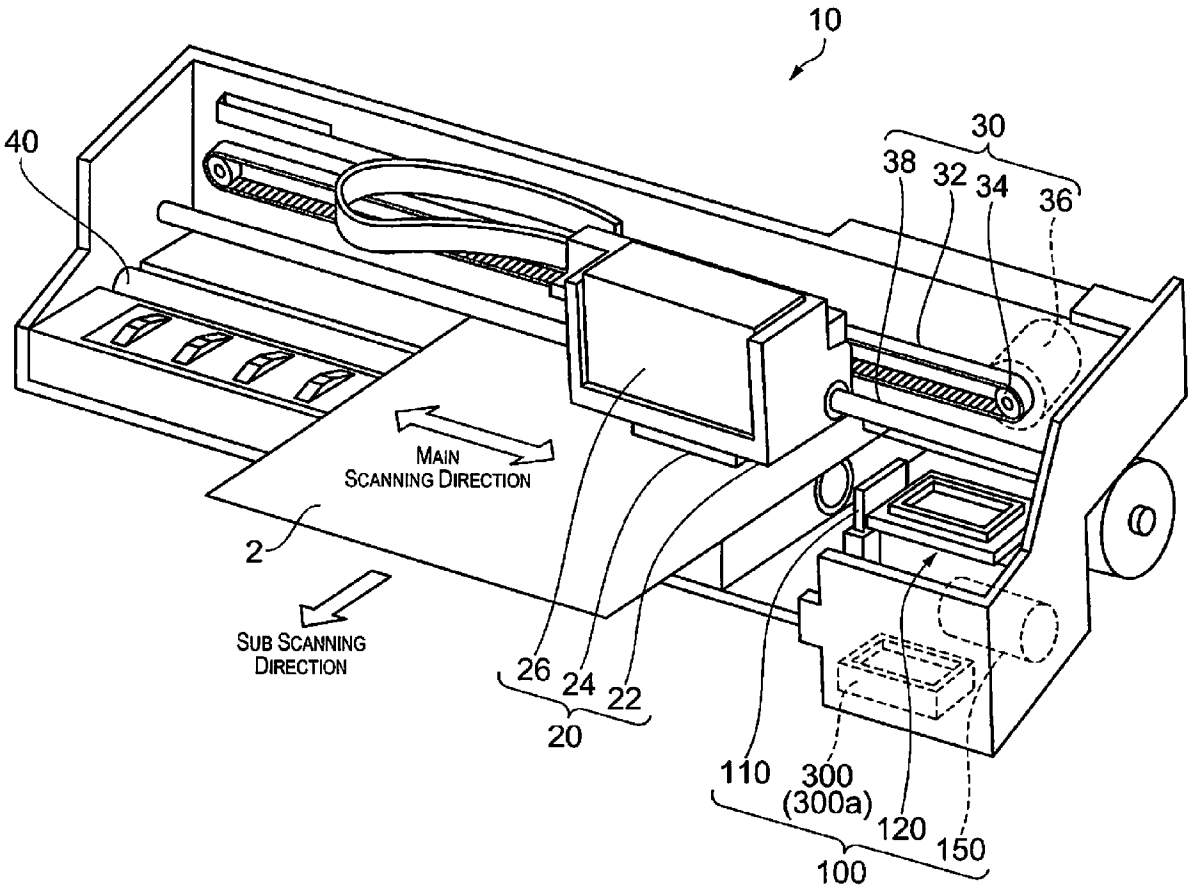
FIG. 5 is a schematic view showing a structure of a liquid droplet ejection device.

FIG. 5 is a schematic view showing the structure of the liquid droplet ejection device. As shown in FIG. 5, the liquid droplet ejection device 10 is constituted by a carriage 20 for forming ink dots on a print medium 2 such as a printing paper while reciprocally moving in a main scanning direction, a driving mechanism 30 for reciprocally moving the carriage 20, a platen roller 40 for feeding the print medium 2, a maintenance mechanism 100 for performing a maintenance so that printing can be performed normally, etc. The carriage 20 is provided with an ink cartridge 26 accommodating ink, a carriage case 22 to which the ink cartridge 26 is mounted, a head 24 mounted on the bottom side (side facing the print medium 2) of the carriage case 22 and configured to eject ink, etc. The head 24 includes a plurality of nozzles for ejecting ink, and the ink in the ink cartridge 26 is introduced to the head 24 and ejected onto the print medium 2 by an accurate amount, so that an image is printed.

The driving mechanism 30 for reciprocally moving the carriage 20 is constituted by a guide rail 38 extending in the main scanning direction, and a timing belt 32 in which a plurality of teeth are formed inside, a driving pulley 34 engaged with the teeth of the timing belt 32, a step motor 36 for driving the driving pulley 34, etc. A part of the timing belt 32 is fixed to the carriage case 22. By driving the timing belt 32, the carriage case 22 can be moved along the guide rail 38. Further, the timing belt 32 and the driving pulley 34 are engaged with each other by teeth. Therefore, by driving the driving pulley 34 by the step motor 36, the carriage case 22 can be moved accurately depending on the driving amount.

The platen roller 40 for feeding the print medium 2 is driven by a non-illustrated driving motor or gear mechanism, so that the print medium 2 can be fed in the sub-scanning direction by a predetermined amount.

Further, the maintenance mechanism 100 is provided in a region outside of the printing area called a home position, and includes a wiper blade 110 for wiping the surface (nozzle face) on which ejection nozzles are formed at the bottom surface side of the head 24, a cap unit 120 pressed against the nozzle face of the head 24 to cap the head 24, and a suction pump 150 for discharging ink as waste ink when driven in a state in which the head 24 is capped with the cap unit 120. By forcibly discharging the ink from the head 24 by the suction pump, the nozzle which became nonejectable due to increased viscosity, destruction of meniscus, effects of paper powder, etc., is recovered, or the increase in ink viscosity is prevented. Further, below the suction pump 150, a waste ink tank 300 (300*a*) for capturing the waste ink discharged from the suction pump 150 is provided. By providing the waste ink tank 300 (300*a*), the outer shape of the liquid droplet ejection device 10 increases. Since the ink permeability and/or the retention capacity of the waste ink absorber 200 (200*a*) equipped on the waste ink tank 300 (300*a*) is improved, the volume of the waste ink absorber 200 (200*a*) capable of the same amount of ink can be reduced. With this, the size of the waste ink tank 300 (300*a*) and the liquid droplet ejection device 10 can be reduced. The waste ink tank 300 (300*a*) has the same structure as that explained in FIG. 2 (FIG. 4), and therefore the explanation will be omitted. The discharged waste ink also includes ink which has not reached a medium, such as flushing ink ejected for the purpose of preventing the viscosity from being increased and the ink deviated from the medium when performing the so-called rimless printing, etc. Therefore, the discharged waste ink is not always the ink discharged from the suction pump 150. The waste ink denotes ink which has discharged from the head but not reached the medium. The liquid droplet ejection device 10 is preferably used to form an image by ejecting especially pigment ink as a liquid droplet. That is, the pigment ink as waste ink can be quickly permeated by the waste ink tank 300 (300*a*) equipped with the waste ink absorber 200 (200*a*) and the permeated ink can be retained.

According to the aforementioned embodiments, the following effects can be obtained.

(1) The first layer 210 and the second layer 220 which are the same in density but different in flame retardant content ratio are stacked. With this, it becomes possible to quickly permeate the waste ink from the first layer 210 relatively low in flame retardant content ratio. Further, in the second layer 220 relatively high in flame retardant content ratio, since the hydrophilic property is high, the absorbed waste ink can be retained assuredly. Therefore, a waste ink absorber 200 meeting both permeability and retention capacity of the waste ink can be provided. Especially to pigment ink, the effects of permeability and retention capacity are effective.

(2) On the surface of the waste ink absorber 200*a*, the first layer 210 and the second layer 220 appear. And, the waste ink discharged toward the surface of the waste ink absorber 200*a* comes into contact with both the first layer 210 and the second layer 220. Thus, the waste ink is quickly absorbed from the first layer 210 with which the waste ink came into contact. Then, the permeated waste ink gradually permeates the second layer 220, and the absorbed waste ink is retained. Therefore, a waste ink absorber 200 meeting both permeability and retention capacity of the waste ink can be provided. Further, on the surface of the waste ink absorber 200*a*, since both of the first layer 210 and the second layer 220 appear, there is no need to set a surface for absorbing waste ink, which can simplify the number of assembling steps.

(3) In the waste ink tank 300 (300*a*) equipped with the aforementioned waste ink absorber 200 (200*a*), even in the case in which the waste ink tank 300 (300*a*) is arranged obliquely or sideways, the absorbed waste ink can be retained to prevent leakage thereof, etc.

(4) In the liquid droplet ejection device 10 equipped with the aforementioned waste ink tank 300(300*a*), the waste ink discharged from the head 24 can be absorbed efficiently, occurrence of defects such as ink leakage, etc., can be prevented, which can secure the reliability.

EXAMPLES

Next, concrete examples according to the present invention will be explained.

1. Mixture (1) Cellulose Fiber

A pulp sheet cut into several centimeter using a cutting machine was defibrated into a cotton form using a Turbo mill (made of Turbo Corporation).

(2) Melting Fiber

It had a core-clad structure, and the clad was made of polyethylene which melts at a temperature of 100° C. or above, and the core was made of melting fiber (Tetoron, made by Teijin Corporation) made of polyester of 1.7 dtex.

(3) Flame Retardant (a) Flame retardant X: aluminum hydroxide (b) Flame retardant Y: ammonium phosphate

2. Formation of Waste Ink Absorber

Example 1

Formation of Waste Ink Absorber A

A mixture C1 (no flame retardant Y) in which 100 parts by weight of cellulose fiber, 15 parts by weight of melting fiber, and 10 parts by weight of flame retardant X were mixed in air, and a mixture C2 in which 95 parts by weight of cellulose fiber, 15 parts by weight of melting fiber, 10 parts by weight of flame retardant X, and 5 parts by weight of flame retardant Y were mixed in air were deposited on a mesh belt alternately. The deposition can be performed while absorbing the mixtures C1 and C2 by a suction device. In Example 1, the mixture C1 and the mixture C2 were deposited alternately ten times respectively. Then, the accumulated deposit was subjected to a heating and pressurizing treatment at 200° C. Thereafter, it was cut into 150 mm×50 mm×12 mm to form a waste ink absorber A. In this waste ink absorber A, a layer low in flame retardant concentration (8 wt %) and a layer high in flame retardant concentration (12 wt %) were repeatedly stacked parallel to one another. The density of each layer was 0.15 g/cm$^3$.

Example 2

Formation of Waste Ink Absorber B

A mixture C1 (no flame retardant Y) in which 100 parts by weight of cellulose fiber, 15 parts by weight of melting fiber, and 10 parts by weight of flame retardant X were mixed in air, and a mixture C3 in which 100 parts by weight of cellulose fiber, 10 parts by weight of melting fiber, 10 parts by weight of flame retardant X, and 5 parts by weight of flame retardant Y were mixed in air were deposited on a mesh belt alternately. The deposition can be performed while absorbing the mixtures C1 and C3 by a suction device. In Example 2, the mixture C1 and the mixture C3 were deposited alternately ten times respectively. Then, the accumulated deposit was subjected to a heating and pressurizing treatment at 200° C. Thereafter, it was cut into 150 mm×50 mm×12 mm to form a waste ink absorber B. In this waste ink absorber B, a layer low in flame retardant concentration (8 wt %) and a layer high in flame retardant concentration (12 wt %) were repeatedly stacked parallel to each other. The density of each layer was 0.15 g/cm$^3$.

Example 3

Formation of Waste Ink Absorber C

A mixture C1 (no flame retardant Y) in which 100 parts by weight of cellulose fiber, 15 parts by weight of melting fiber, and 10 parts by weight of flame retardant X were mixed in air, and a mixture C2 in which 95 parts by weight of cellulose fiber, 15 parts by weight of melting fiber, 10 parts by weight of flame retardant X, and 5 parts by weight of flame retardant Y were mixed in air were deposited on a mesh belt alternately. At this time, the mixtures C1 and C2 were continuously deposited alternately while moving the mesh belt so that the mixtures C1 and C2 were stacked obliquely. The deposition can be performed while absorbing the mixtures by a suction device. In Example 3, the mixture C1 and the mixture C2 were deposited alternately ten times respectively. Then, the accumulated deposit was subjected to a heating and pressurizing treatment at 200° C. Thereafter, it was cut into 150 mm×50 mm×12 mm to form a waste ink absorber C. In this waste ink absorber C, a layer low in flame retardant concentration (8 wt %) and a layer high in flame retardant concentration (12 wt %) were repeatedly stacked obliquely. The density of each layer was 0.15 g/cm$^3$.

Comparative Example 1

Formation of Waste Ink Absorber R1

A mixture C1 (no flame retardant Y) in which 100 parts by weight of cellulose fiber, 15 parts by weight of melting fiber, and 10 parts by weight of flame retardant X were mixed in air was deposited on a mesh belt. The deposition can be performed while absorbing the mixture by a suction device. Then, the accumulated deposit was subjected to a heating and pressurizing treatment at 200° C. Thereafter, it was cut into 150 mm×50 mm×12 mm to form a waste ink absorber R1. In this waste ink absorber R1, the flame retardant concentration was uniform (8 wt %). The density of the waste ink absorber R1 was 0.15 g/cm$^3$.

Comparative Example 2

Formation of Waste Ink Absorber R2

A mixture C2 in which 95 parts by weight of cellulose fiber, 15 parts by weight of melting fiber, 10 parts by weight of flame retardant X, and 5 parts by weight of flame retardant Y were mixed in air was deposited on a mesh belt. The deposition can be performed while absorbing the mixture by a suction device. Then, the accumulated deposit was subjected to a heating and pressurizing treatment at 200° C. Thereafter, it was cut into 150 mm×50 mm×12 mm to form a waste ink absorber R2. The waste ink absorber R2 was uniform in flame retardant concentration (12 wt %). The density of the waste ink absorber R2 was 0.15 g/cm$^3$.

3. Evaluation

Next, in the aforementioned Example 1 to Example 3 and Comparative Example 1 and Comparative Example 2, the ink permeability, the ink retention capacity, the deposition property and the flame retardancy were evaluated. Each evaluation method was as follows.

(a) Evaluation Method of the Ink Permeability and the Ink Retention Capacity

Figure 6A:
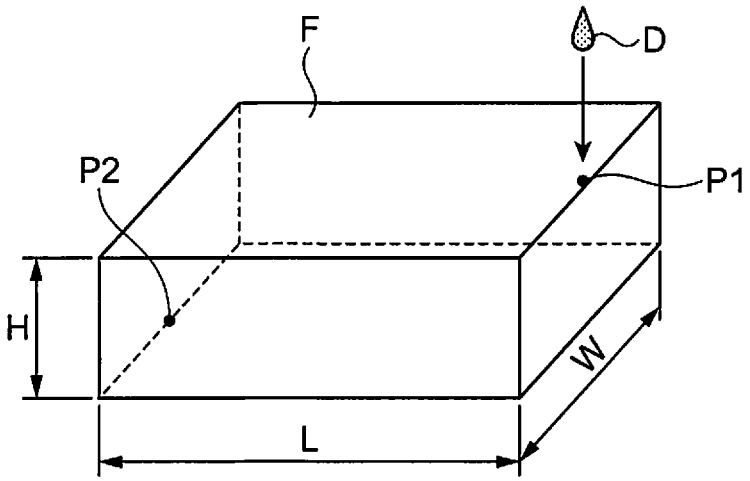
FIG. 6A is a schematic diagram showing an evaluation method of ink permeability and retention capacity of a waste ink absorber.

FIG. 6 is a schematic diagram showing the evaluation of the ink permeability and the ink retention capacity of the waste ink absorber. As shown in FIG. 6A, the ink absorber F of 150 mm (L)×50 mm (W)×12 mm (H) was placed on a flat surface, and pigment ink of 80 ml was slowly ejected from the first point P1 of the upper surface. When it was not permeated into the absorber F, it was left for 5 minutes, and then the ejection was continued. If it was not permeated after leaving for 5 minutes, it was deemed that no ink was permeated, and the ink permeability was judged as NG. On the other hand, if all of them could be permeated, the ink permeability was judged as OK. In the waste ink absorbers A, B, and C according to Examples 1 to 3, the pigment ink D was ejected on an upper surface to which the layer low in flame retardant concentration and the layer high in flame retardant concentration appear.

Figure 6B:
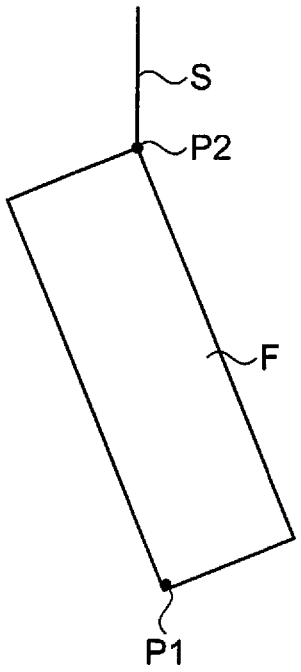
FIG. 6B is a schematic diagram showing the evaluation method of the ink permeability and the retention capacity of the waste ink absorber.

When all ink could be permeated, it was left for 5 minutes, and as shown in FIG. 6B, the ink absorber was suspended from the second point P2 using a strap S with the first point P1 arranged below. In this suspended state, the permeated ink gathers at one end portion of the ink absorber F and is hard to be retained. When the ink was dripped off from the ink absorber F, it was deemed that ink could not be retained, and the ink retention capacity was judged as NG. On the other hand, when no ink was dripped off, the ink retention capacity was judged as OK. When the judgment of the ink permeability was NG, since a desired amount could not be absorbed, no judgment of the ink retention capacity was performed. With this evaluation, even if the liquid droplet ejection device and/or the waste ink tank is arranged obliquely, it is apparent that no ink leakage occurs.

(b) Evaluation Method of Ink Deposition Property

An ink absorber F of 150 mm (L)×50 mm (W)×12 mm (H) was placed on a flat surface, and under the environment of 20% RH at 40° C., ink was dropped by 0.4 g at a time every hour on a central portion on the upper surface of the placed absorber F. After passing 240 hours, if the thickness of the solid deposit on the surface of the ink absorber F was less than 1 mm, the ink deposition property was judged as OK. On the other hand, if the thickness of the deposit was 1 mm or more, the ink deposition property was judged as NG.

(c) Evaluation Method of the Flame Retardancy

About the ink absorber F of 150 mm (L)×50 mm (W)×12 mm (H), the burning rate was obtained by the method compliant with JIS K6400-6. Concretely, the ink absorber F was held horizontally. With one end of the ink absorber held, the other end thereof was brought into contact with 38 mm fire for 60 seconds and the burning rate of between gauges 100 mm was obtained. When the burning rate was 20 mm/min or less, it was judged as OK, and the burning rate was faster than 20 mm/min, it was judged as NG. By this evaluation, it is understood that slower the burning rate, it is excellent in flame retardancy.

In the aforementioned Examples and Comparative Examples, the ink permeability, the ink retaining property, the ink deposition property, and the flame retardancy were evaluated. The evaluation results are shown in Table 1.

TABLE 1

| | Ink permeability | Ink retaining property | Ink deposition property | Flame retardancy |
|---|---|---|---|---|
| Example 1 | OK | OK | OK | OK |
| Example 2 | OK | OK | OK | OK |
| Example 3 | OK | OK | OK | OK |
| Comparative Example 1 | OK | NG | OK | NG |
| Comparative Example 2 | NG | — | NG | OK |

As shown in Table 1, according to the waste ink absorbers A, B, C (Example 1, 2, 3) according to the present invention, all of evaluations on the ink permeability, the ink retaining performance, the ink deposition property and the fire-retardancy were excellent. On the other hand, in the waste ink absorbers R1 and R2 of Comparative Example 1, no satisfactory result could be obtained. In Comparative Example 1, since the fire-retardancy content ratio was low, although the ink permeability was good, the ink retaining performance was deteriorated. Further, the fire-retardancy was also deteriorated. In Comparative Example 2, since the fire-retardancy content ratio was high, the ink permeability was deteriorated. To the contrary, in Examples 1 to 3, since the layer low in retardant content ratio and the layer high in retardant content ratio were stacked alternately, the ink permeability, the ink retention capacity and the ink deposition property could be satisfied. Further, since the layer high in flame retardant content ratio was contained, the fire-retardancy could also be satisfied.

In some cases, there is a case in which the lamination of the layer low in flame retardant and the layer high in flame retardant, which is a feature of this application, cannot be recognized as an appearance with eyes. As a method for verification on such a case, it can be easily analyzed by, e.g., a method of an elemental mapping of an electron microscope. As to the oblique lamination, by tearing off the absorbing material after impregnation of water or ink, the layer direction can be recognized.

The aforementioned Examples are employed as a waste ink tank 300 (300*a*) and a waste ink absorber 200 (200*a*) for use in a liquid droplet ejection device 10. Here, ink includes various kinds of liquid compositions, such as, common aqueous ink, oil ink, pigment ink, dye ink, solvent ink, resin ink, sublimation transfer ink, gel ink, hot melt ink, ultraviolet cure ink, etc. Further, ink can be any materials that a head 24 can eject. For example, it is enough that the material is in a liquid phase state, and ink includes not only liquid crystal, a liquid state material high or low in viscosity, zol, gel liquid, fluid material such as inorganic solvent, organic solvent, solution, liquid resin, liquid metal (metal molten solution), liquid as one condition of a material, but also a material in which functional material particles of solid materials such as pigments or metal particles are dissolved, dispersed or mixed in a solvent, etching liquid, lubricating oil.

Further, the liquid droplet ejection device can be, other than an ink jet printer, a device for ejecting ink including electrode materials or materials such as coloring materials used to produce, for example, a liquid crystal display, an EL (electroluminescence) display, a surface emitting display, or a color filter in a dispersed or dissolved manner, a device for ejecting a bio organic substance for use in a bio chip production, a device for ejecting ink as a sample used as a precision pipette, a printing device or a micro dispenser. Furthermore, a device for ejecting lubricating oil to a precision machine such as a clock, a camera, etc., at a pin point, a device for forming, e.g., a small rounded lens (optical lens) for use as an optical communication element, a device for ejecting ultraviolet curable liquid and hardening it by light or heat, or a device for ejecting etching liquid such as acid, alkali, etc., to etch a substrate, etc., can be employed. The present invention can be applied to any one of liquid droplet ejection device among these devices.

In the aforementioned Examples, in order to prevent scuffing of the surface of a waste ink absorber 200 (200*a*), a thin nonwoven fabric can be adhered to the surface. Since the nonwoven fabric to be adhered is thin as compared with the waste ink absorber 200 (200*a*), the influence to the ink permeability or retaining performance is small.

In the aforementioned Examples, the waste ink absorber 200 (200*a*) is formed into a rectangular shape, but not limited to it. A rectangular shape can partially have a cutting and/or dent, and the shape can be non-rectangular and include an arc portion and/or an inclined portion.

In the drawings of the aforementioned Example, it was depicted that the first layer 210 and the second layer 220 had the same thickness, but the thickness of each layer can be changed depending on ink. For example, if ink is large in viscosity and hard to impregnate, it is preferable that the thickness of the first layer 210 is increased than the thickness of the second layer 220 to enhance the permeability. To the contrary, if the viscosity is small and it is easy to be impregnated, it is preferable that the thickness of the first layer 210 is decreased as compared to the thickness of the second layer 220.

Although the density was described in each Example and Comparative Example, these are samples.

In the aforementioned Examples, the pulp sheet includes a wood pulp of a needle-leaf tree, a broad-leaf tree, etc., non-wood plant fibers such as hemp, cotton, kenaf, etc.

In the aforementioned Examples, cellulose fibers were used as fibers which constitute a main component of the waste ink absorber, but it is not limited to cellulose fibers as long as it is a material which can absorb ink and differentiate the density. The fiber can be a fiber made from plastic such as polyurethane or polyethylene terephthalate (PET) or another fiber such as wool.

The method of forming the waste ink absorber is not limited to the method recited in the aforementioned Examples. As long as the features of the present application can be exerted, another production method such as a wet type method can be employed.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A waste ink absorber for absorbing waste ink discharged from a head for ejecting ink, comprising:

a plurality of layers each of which includes flame retardant, each of the layers having the same in density, the layers being stacked and having a first layer and a second layer that are stacked on top of each other, the first layer having a content ratio of the flame retardant different from a content ratio of the flame retardant that the second layer has.

2. The waste ink absorber according to claim 1, wherein each of the layers further includes fiber, the first layer has the content ratio of the flame retardant lower than the content ratio of the flame retardant that the second layer has, and the first layer has a content ratio of the fiber higher than a content ratio of the fiber that the second retardant layer has.

3. The waste ink absorber according to claim 2, wherein the fiber is a fiber which functions as a main component of the waste ink absorber.

4. The waste ink absorber according to claim 2, wherein the fiber is a melting fiber.

5. The waste ink absorber according to claim 1, wherein, the layers are stacked parallel to one another in a side cross-sectional view of the waste ink absorber.

6. The waste ink absorber according to claim 1, wherein, the layers are stacked obliquely relative to an outer surface of the waste ink absorber in a side cross-sectional view of the waste ink absorber.

7. A waste ink tank comprising:

the waste ink absorber according to claim 1, and an accommodation portion configured to accommodate the waste ink absorber.

8. A liquid droplet ejection device comprising:

a head configured to eject ink; and the waste ink tank according to claim 7, the waste ink tank configured to capture waste ink discharged from the head.

* * * * *